United States Patent [19]

Zoleski et al.

[11] 4,282,107

[45] Aug. 4, 1981

[54] DIESEL CRANKCASE LUBRICANT COMPOSITION

[75] Inventors: Benjamin H. Zoleski, Beacon; Rodney L. Sung, Fishkill, both of N.Y.; Gordon R. Schierberg, Port Arthur; Gayle P. Hebert, Port Neches, both of Tex.

[73] Assignee: Texaco Inc., White Plains, N.Y.

[21] Appl. No.: 78,870

[22] Filed: Sep. 26, 1979

[51] Int. Cl.[3] ..... C10M 1/54

[52] U.S. Cl. ..... 252/42.7; 252/46.4

[58] Field of Search ..... 252/42.7, 46.4

[56] References Cited

U.S. PATENT DOCUMENTS

| | | | |
|---|---|---|---|
| 3,474,035 | 10/1969 | Dadura | 252/42.7 |
| 3,528,917 | 9/1970 | Dadura et al. | 252/42.7 |
| 3,549,534 | 12/1970 | Holstedt et al. | 252/42.7 |
| 3,706,632 | 12/1972 | Day et al. | 252/42.7 |
| 3,761,414 | 9/1973 | Haugen et al. | 252/42.7 |
| 3,969,235 | 7/1976 | Sung et al. | 252/42.7 |
| 4,104,180 | 8/1978 | Burnop | 252/42.7 X |
| 4,171,269 | 10/1979 | Sung et al. | 252/42.7 X |
| 4,171,270 | 10/1979 | Sung et al. | 242/42.7 |

*Primary Examiner*—Andrew Metz

*Attorney, Agent, or Firm*—Carl G. Ries; Robert A. Kulason; Henry W. Archer

[57] ABSTRACT

A diesel crankcase lubricant composition containing a non-$CO_2$ blown 2:1 calcium hydroxide overbased calcium salt of a sulfurized alkylphenolate, an alkenyl succinimide and a pour depressant in a mineral oil base. The composition has excellent silver frictional control without requiring incorporation of a silver friction modifier.

9 Claims, No Drawings

DIESEL CRANKCASE LUBRICANT COMPOSITION

BACKGROUND OF THE INVENTION

1. FIELD OF THE INVENTION

This invention relates to a lubricating oil composition particularly suitable as a railway diesel engine oil.

2. PRIOR ART DESCRIPTION

The prior art to which this invention relates evidences activity and includes coassigned U.S. Pat. Nos. 3,969,235; 3,474,035; 3,528,917; and 3,761,414, as well as U.S. Pat. Nos. 7,010,106; 3,377,281; 3,367,867; 4,016,093; 3,562,159 and 3,775,321.

Over the past several years the railroad engine manufacturers were required to modify their new engines, as well as the older engines which were being overhauled, to meet certain environmental criterion. The engine modifications caused lube oil drain periods to be reduced. Instead of the normal six-month drain periods with 6 TBN (Total Base Number) oils, the oil must now be drained at about 3 months. To extend the oil drain periods to their original 6-month interval the engine builders are now recommending higher TBN oils (about 10). The 10 TBN oils are usually more expensive than 6 TBN oils.

In a related coassigned patent application, Ser. No. 754,658, filed Dec. 27, 1976, now U.S. Pat. No. 4,169,799, it is disclosed that the combination of components consisting of a 2:1 overbased calcium salt of a sulfurized alkyl phenolate, a alkenylsuccinimide and a chlorinated hydrocarbon in a mineral oil base stock mixture provides a 10 TBN product which outperforms commercial blends in oxidative stability, corrosion control and alkaline retention and is competitive economically with them. However, it was necessary to use a chlorinated hydrocarbon in the above formulation to maintain the excellent silver frictional characteristics of the oil.

SUMMARY OF THE INVENTION

In accordance with this invention, there is provided a lubricating oil containing an alkenyl succinimide, a pour depressant and a non-$CO_2$ blown 2:1 calcium hydroxide overbased calcium sulfurized alkylphenol prepared by overbasing at a temperature between 350° F. and 425° F. a sulfurized calcium alkylphenolate having a calcium content between about 1 and 8 weight percent and a sulfur content between about 0.5 and 12 weight percent with a calcium alkoxide sparging with an inert gas; steaming the mixture, resuming sparging at a gradually increasing rate and recovering the product.

DETAILED DESCRIPTION OF THE INVENTION

The lubricating composition of this invention is prepared by the following steps:

Overbasing by means of a calcium alkoxyalkoxide of the formula:

$$Ca(-O-A-OR^1)_2$$

where A is a divalent saturated aliphatic hydrocarbon radical (alkanediyl) of 1 to 6 carbons and $R^1$ is alkyl of from 1 to 25 carbons at a temperature between about 350° and 425° F., preferably between about 320° and 425° F., a previously nitrogen-sparged sulfurized calcium alkylphenolate having a calcium content between about 1 to 8.0 weight percent and a sulfur content between about 0.5 and 12.0 weight percent, utilizing between about 1.8 and 2.2 moles of calcium alkoxyalkoxide.

The sulfurized calcium alkylphenolates are in actuality a complex mixture of many compounds. One hypothetical representation employed in the art is as follows:

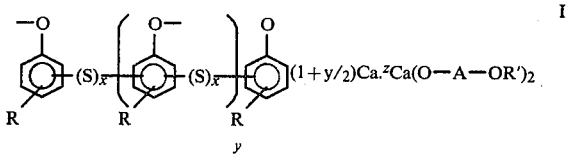

I where R, R' and A are as heretofore defined, x is an integer from about 1 to 4, y is an average integer of from 0 to 10 and z is an average integer of 0 to about 0.1. When z is greater than 0 the sulfurized product is considered overbased.

In a second stage, the above reaction mixture is sparged with an inert gas, perferably nitrogen, for about 1 hour at a rate of RR=0.58 (9.8 SCFH). The rotometer nitrogen flow rate is then cut back to and continued for 3 to 4 ½ hours.

In a third step, the blown mass is steamed at the reaction temperature for one-half to two hours at the desired rate. Both the steam time and the rate of steaming are critical. Nitrogen flow is continued during this steaming step.

In a fourth step, the nitrogen sparging is slowly increased to avoid foaming over an hour and continued for about two hours.

In a fifth step, in a final stage, a diluent oil and a filter aid slurry are added to the reaction mass which is then centrifuged or otherwise separated. The product is a 2:1 calcium hydroxide overbased calcium sulfurized alkylphenol of the above formula (I), wherein z ranged from 1.8 to 2.2 in an oil.

The starting sulfurized calcium phenolates are described and claimed in coassigned U.S. Pat. No. 3,969,235 issued July 13, 1976.

Examples of the calcium alkoxyalkoxide reactants contemplated herein are calcium 2-methoxyethoxide, calcium 2-methoxypropoxide, calcium 3-methoxybutoxide, and calcium 2-ethoxyethoxide.

The inert gas normally employed is nitrogen and, most preferably, nitrogen with a purity of at least about 99 weight percent.

The hydrocarbon diluent oils employed in the preparation of the sulfurized calcium alkylphenolate also function to form a portion of the base oil in the final compositions containing the sulfurized alkylphenolate. Suitable base oils and diluent oils include a variety of hydrocarbon lubricating oils, such as naphthenic base, paraffinic base and mixed naphthenic and paraffinic base oils. Railway diesel oils include SAE 30 through 50 grade oils. The SAE 40 oil is 215 cSt at 40° C. or 900 SUS at 100° F. The 30 SAE oil is 150 cSt at 40° C. and 600 SUS at 100° F. The 50 SAE oil is 270 cSt at 40° C. and 1225 SUS at 100° F.

The formed sulfurized calcium alklphenolate product contents in lubricating oil compositions contemplated herein range anywhere from 0.1 to 90 weight percent. The higher concentrations, e.g., between about 10 and 90 weight percent, sometimes referred to in the art as concentrates, are normally found in lubricant compositions resulting directly from the manufacture of the sulfurized calcium alklphenolate ingredient in finished (dilute) lubricating oil compositions employed for engine use in desirably between about 0.1 and 7.5 weight percent with a calcium concentration of between about 0.06 and 0.5 weight percent, preferably about 0.1 and 0.4 weight percent. The concentrates are principally formed for storage and transport and are subsequently blended to finished oil composition for engine use having a sulfurized calcium alkylphenolate of between about 0.1 and 10 weight percent.

In the finished lubricating oil compositions, other additives may be included such as supplementary dispersants, pour depressors, antioxidants, viscosity index improvers, oleagenous agents and antifoamant mixtures thereof. Exactly what other additives are included in the finished oil and the particular amounts therein will, of course, depend on the particular use the finished product is to be put to. One of the most suitable uses found for the overbased calcium alkylphenolate produced herein are lubricants for railway diesel engines.

A preferred class of dispersant additives is derivative of alkylene succinimide polyamine characterized by the formula:

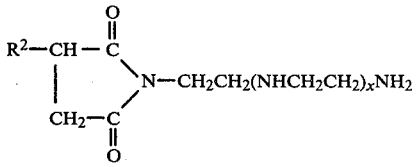

where $R^2$ is alkenyl of from 50 to 200 carbons, x is an integer of from 0 to 10. Preferably, the alkylene group is polybutene having a molecular weight of about 1200 and the polyamine is tetraethylene pentamine.

A preferred antifoamant is a methyl silicone polymer (12500 cs at 770° F.) in kerosene.

A preferred pour depressant is a polymethacrylate. The following examples further illustrate the invention but are not to be construed as limitations thereof.

EXAMPLE

This example describes the preparation of the product of the invention.

There is provided a reactor arranged to vent and collect overhead and a caustic scrubber filled with fresh caustic. To the reactor are charged over 0.7 hours at ambient temperature, 13,388 pounds (10.8 lb. mol, mol. ratio 1.0) of the calcium salt of a sulfurized alkylphenol. The system is then heated to 350° F. over a 1.3 to 2 hours period while blowing with nitrogen at a rate of 150 SCFH.

In a second step, there is charged, at a uniform rate over a 2 hour and 12 minute period, 10,424 pounds of calcium methoxymethoxide (0.4 weight percent calcium; 23.3 lb. mol; mol-ratio 2.2). It is important, at this point, to maintain the system temperature at 350° F. and not to exceed a 10 psig pressure on the system.

In a third step, after the calcium reagent charge is completed, $N_2$ blowing is initiated at RR=0 58 (9.8 SCFH) for one hour. This rate is reduced to RR=0.45 (2.9 SCFH) for three hours and 50 minutes while maintaining the reactor at 350° F.±5° F.

In a fourth step, nitrogen blowing is replaced by steaming with 482 pounds of steam (26.6 lb. mol; mol-ratio 2.5). Steaming is continued for 90 minutes maintaining the reactor temperature at 350° F.

In a fifth step, the nitrogen stripping rate is increased to RR=0.58 (9.8 SCFH) over a one hour period to avoid foaming and continued for two hours at 350° F.

In a sixth step, 4320 pounds of diluent oil are added.

In a final step, 179 pounds of Kenite 70 filter aid are mixed with the reaction mixture for 30 minutes. The mass is circulated through a sparkle filter under a pressure of 30 psig and the product is collected by centrifuging.

A typical composition of a 10 TBN engine oil which can be blended to have an original TBN value of 0 through 15 is given below in Table I.

TABLE I

| | Wt. % |
|---|---|
| Oil A | 3.00 |
| Oil B | 5.00 |
| Oil C | 45.45 |
| Oil D | 37.00 |
| 2:1 calcium hydroxide overbased calcium salt of sulfurized alkylphenolate giving minimum of 0.35% calcium for 10 TBN oil | 5.50 |
| Alkenyl succinimide to provide a minimum of 0.04% N. | 4.00 |
| Pour depressant | 0.05 |
| Antifoam (silicone) ppm | 150 |

Blends containing the additive of the invention and competitive other blends without it, were tested by the following tests:

1. The Union Pacific Oxidation Test (UPOT) is used by railroads to judge the acceptability of an oil for use in their equipment. The test measures corrosion (50 mg. max. limit) and oxidative stability (20% max. viscosity increase at 100° F.) as well as other used oil parameters (pH-which is used by some railroads to judge the oil drain interval—below 5, drain; above 5, satisfactory; TBN can be used as a measure of alkaline retention). The test method involves bubbling 5 liters of oxygen per hour through 300 mls. of test oil composition at 285° F. in which there is immersed a 1×3×0.06 inch steel backed copper-lead test specimen cut from bearing stock. The viscosity of the test oil is measured before and after the 144 hour test period and the greater the difference in viscosity the greater the oxidative deterioration of the sulfurized calcium alkylphenolate composition. In addition, the test specimen is weighed before and after the test period and the greater the weight loss of test specimen the greater the oxidative deterioration of the test formulation. The larger the amount of copper, iron and lead moieties found in the oil after test, the greater the oxidative deterioriation thereof.

2. The General Electric Co. uses the G.E. Oxidation Test to evaluate the performance of an oil for use in their equipment. In this test, an oil is catalyzed using bronze and steel metal specimens at 330° F. for 48 hours. The viscosity of the 48 hour oil sample is determined.

3. The Electro-Motor Division (EMD) of General Motors employs their EMD Silver Corrosion Test to approve oils for use in their engines. In this test the oil is evaluated at 325° F. for 72 hours and given demerits for not attaining certain criteria. The critical areas of evaluation are silver corrosion, oil thickening, pH decrease, TAN increase and TBN depletion. The rating classifications for the EMD Silver Corrosion Test are as follows:

| Demerits | Rating |
|---|---|
| 0–3 | Excellent |
| 30–60 | Good |
| Over 60 | Unsatisfactory |

4. The Silver Disc Friction Test—This method measures the steel on silver lubricating properties of an oil and is used to screen diesel engine lubricants for use in EMD, type 567 engines. This engine uses a piston carrier-bearing combination of steel and silver. The basic equipment used for the test is a Precision-Shell 4-Ball Wear Test Machine. A special adapter is used which allows using three ¼ inch dia. × 1/16 inch thick discs in place of the three steel balls normally used in this tester. The test discs are punched from sheets of fine silver. The upper test piece is a standard ½ inch dia., AFGM Grade 25, chrome steel ball.

The test discs, steel ball and ball pot are cleaned in naptha and air dried. The discs are then inserted into the holder which is placed in the ball pot; enough test oil is added to completely cover the test discs. The test ball is then inserted into the ball chuck and the ball pot is placed in the normal running position. The break-in procedure, as shown below, is then performed and the test heater adjusted to running temperature. The test is started when the proper temperature is reached. Test conditions are shown below:

Break in: 60 Kg load, 1 revolution by hand
Running Load: 23 Kg
Speed, RPM: 600
Oil Temperature °F.: 500° F. and 450° F.
Test Duration: 30 Minutes
Oil Charge: 10 cc Approximate As indicated above, the procedure calls for testing at both 450° and 500° F. However, the 500° F. run should be made first and if a "good" or "excellent" rating is obtained at this temperature, the 450° F. run can be omitted.

The results of the above tests are presented in Table II, below, for representative Blend E and comparative blends 1 to 4.

It will be noted from Table II that Blend 1, (a commercial 10 TBN diesel oil) fails the UPOT on the basis of corrosion and oxidative stability and retains none of its original TBN. Blend 2 (a 6TBN oil) passes the UPOT with an alkaline retention of 7 percent. The deposit modified oil (3) also passes the UPOT and shows a 23% alkaline retention.

Blend 4 (a commercial version of the friction modified oil) fails the UPOT in corrosion and viscosity increase and retains no residual alkalinity. The composition of this invention (5) passes the UPOT and retains more alkalinity (35%) than any of the aforementioned oils.

Unpredictably and unexpectedly, Blend 5 maintains the excellent silver frictional characteristics of a commercial diesel engine oil, without degrading any of the other performance parameters of the oil, and this without the use of a silver friction modifier (chlorinated hydrocarbon) required by Blend 2.

Table II thus illustrates the superiority of the 2:1 hydroxide overbased calcium sulfurized alkylphenol of the invention in respect to alkaline retention silver corrosion and percent viscosity increase. As a corollary, such a showing illustrates the material difference in the composition of the alkylphenol of the invention in respect to those of the prior art.

TABLE II

| Oil Blend | 1 | 2 | 3 Friction Modified Oil | 4 Commercial Detergent with Friction Modifier | 5 Composition of Invention |
|---|---|---|---|---|---|
| Composition, Wt. % | | | | | |
| Base Oil Mixture | 89.90 | 90.25 | 91.0 | 89.65 | 90.95 |
| Detergent[a] | — | 6.50 | — | | |
| Detergent[b] | — | — | 4.80 | | |
| Oronite 218A[c] | | | | 7.00 | |
| Dispersant[d] | — | 3.20 | — | | |
| Dispersant[e] | — | — | 4.00[a] | 3.30[a] | 4.00 |
| Inhibitor[f] | — | 0.05 | — | 0.05 | |
| Friction Modifier[g] | — | — | 0.10 | — | — |
| Antifoamant[h] | — | 150 | 150 | 150 | |
| Oronite 2918N[i] | 10.10 | — | — | — | |
| Example I Additive[j] | — | — | — | — | 5.00 |
| Pour depressant[k] | — | — | — | — | 0.05 |
| TBN (Total Base Number) | 11.5 | 6.0 | 12.0 | 12.0 | 11.5 |
| Calcium, % | 00.35 | 0.20 | 0.35 | 0.38 | 0.35 |
| Phosphorus, % | — | 0.030 | 0 | — | — |
| Nitrogen, % | 0.075 | — | 0.06 | 0.06 | 0.06 |
| UPOT, Mg.Wt. Loss[1] | 507 | 8 | 33 | 644 | 1 |
| pH | 3.6 | 4.6 | 7.8 | 4.1 | 8.7 |
| TAN (Total Acid Number) | 17.6 | 3.6 | 1.1 | 14.0 | 1.4 |
| TBN | 0 | 0.40 | 3.9 | 0 | 4.0 |
| SAN | 0.41 | 0 | 0 | 0 | 0 |
| % Viscosity Inc. | 281 | 17 | 16.2 | 2.5 | 0.03 |
| Cu, ppm | 81 | 6 | 0 | 96 | 7.2 |
| Fe, ppm | 0 | 0 | 0 | 0 | 0 |
| Pb, ppm | 600 | 6 | 81 | 600 | 0 |
| % Orig. Alkalinity Retained | 0 | 7 | 23 | 0 | 35 |
| Silver Disk Friction Test | Excellent | Excellent | Excellent | Excellent | Excellent |
| General Electric Oxid. Test | | | | | |
| % Viscosity Index | 6.7 | 4.7 | 0 | 7.8 | 7.1 |
| EMD Silver Corrosion | | | | | |

TABLE II-continued

| Oil Blend | 1 | 2 | 3 Friction Modified Oil | 4 Commercial Detergent with Friction Modifier | 5 Composition of Invention |
|---|---|---|---|---|---|
| Test 325° F. Silver Corrosion Wt. Change, Mgs. | +0.9 | +0.2 | +0.3 | +0.5 | +0.1 |
| % H | 6.9 | 6.8 | 8.0 | 8.1 | 8.8 |
| TAN | 2.0 | 0.81 | 0.76 | 0.84 | 0.6 |
| TBN | 2.4 | 1.9 | 5.4 | 4.3 | 7.3 |
| % Viscosity Increase | 33 | 19 | 21 | 27 | 16.6 |
| % Orig. Alkalinity Retained | 21 | 32 | 45 | 35 | 63 |

[1]UPOT requirements 50 mg. max. weight loss and 20% viscosity increase.
[a]Sulfurized calcium alkylphenolate.
[b]2:1 overbased sulfurized calcium alkylphenolate.
[c]0.7:1 overbased sulfurized calcium alkylphenolate.
[d]$NO_2$ - blown ethoxylated "Indopol #300" olefin-$P_2S_5$ acid.
[e]alkenylsuccinimide tetraethylenepentamine.
[f]2,5-dimercapto-1,3,4 thiodiazole.
[g]chlorinated paraffin.
[h]methyl silicone polymer.
[i]additive package composed of sulfonates, phenolates, succinimide dispersant and inhibitors.
[j]2:1 overbased non-$CO_2$ blown sulfurized calcium alkylphenolate.
[k]methacrylate polymer.

The present invention may be embodied in other specific forms without departing from the spirit or essential attributes thereof and, accordingly, reference should be made to the appended claims, rather than to the foregoing specification as indicating the scope of the invention.

We claim:

1. A lubricating oil composition characterized by the absence therefrom of a silver friction modifier as well as by improved alkaline retention, silver corrosion protection and percent viscosity increase comprising a hydrocarbon oil of lubricating viscosity containing: an alkenyl succinimide detergent-dispersant, a pour depressant and from 0.1 to 90 weight percent of a non-$CO_2$ blown 2:1 calcium hydroxide overbased calcium sulfurized alkylphenol having an alkylphenol to calcium metal ratio of about 2 to 3 , produced by the steps of:

(a) overbasing at a temperature between about 350°and 425° F. under a pressure not exceeding 10 psig with from about 1.8 to 2.2 moles of a calcium alkoxyalkoxide of the formula:

$$Ca(O—A—OR')_2$$

where A is alkanediyl of from 1 to 6 carbons and R' is alkyl of from 1 to 25 carbons, a sulfurized calcium alkylphenolate having a calcium content between about 1 and 8.0 weight percent which has the formula:

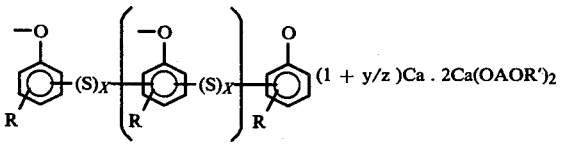

wherein R, R' and A are as shown above; x ranges from about 1 to 4, y ranges from 0 to 1.0 and z ranges from 0 to 0.1;

(b) sparging the resulting mixture with an inert gas substantially at the above temperature;

(c) steaming the sparged mass again at substantially the said temperature;

(d) repeating said sparging with said gas at an increased stripping rate, continued for about two hours at about 350° F.;

(e) adding a diluent oil;

(f) adding a filter aid to the reaction mass, and (g) separating a product having the above formula wherein z ranges from 1.8 to 2.2.

2. The composition of claim 1, wherein said detergent-dispersant is characterized by the formula:

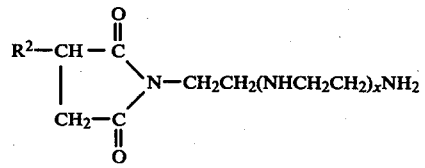

where $R^2$ is alkenyl of from 50 to 200 carbons, x is an integer of from 0 to 10.

3. The composition of claim 1, wherein said pour depressant is a polymethacrylate.

4. The composition of claim 2, wherein said compound is a polybutene succinic anhydride derivative of tetraethylene pentamine.

5. The composition of claim 1, containing from about 0.1 to 7.5 weight percent of said calcium salt.

6. The composition of claim 1, wherein said lubricating oil has a viscosity at 40° C. of between about 150 1 and 270 cSt.

7. The composition of claim 1, wherein said lubricating oil has a viscosity of about 215 cSt at 40° C.

8. The composition of claim 1, containing also a steam hydrolized $P_2S$ ethoxylated polyolefin.

9. The composition of claim 1, wherein said steaming (c) is carried out for one-half to two hours.

* * * * *